US005168783A

United States Patent [19]

Shea

[11] Patent Number: 5,168,783

[45] Date of Patent: Dec. 8, 1992

[54] LOCKING CABLE CLAMP

[76] Inventor: Thomas M. Shea, 51 Harlem St., Worcester, Mass. 01610

[21] Appl. No.: 828,289

[22] Filed: Jan. 30, 1992

[51] Int. Cl.[5] ..... B25B 7/02

[52] U.S. Cl. ..... 81/424.5; 81/418; 81/419

[58] Field of Search ..... 81/424.5, 418, 419, 81/426, 426.5

[56] References Cited

U.S. PATENT DOCUMENTS

| | | | |
|---|---|---|---|
| 755,440 | 3/1904 | Bonschur | 81/418 |
| 1,769,332 | 7/1930 | Coffing . | |
| 2,724,986 | 11/1955 | Schulze . | |
| 3,653,284 | 4/1972 | Pynchon et al. . | |
| 4,318,316 | 3/1982 | Guilliams . | |
| 4,386,461 | 6/1983 | Plummer . | |
| 4,386,542 | 6/1983 | Verna . | |
| 5,007,312 | 4/1991 | Bailey . | |

*Primary Examiner*—Bruce M. Kisliuk
*Assistant Examiner*—Lawrence Cruz
*Attorney, Agent, or Firm*—Thomas M. Shea

[57] ABSTRACT

The tool of the present invention comprises a pair of locking pliers specifically designed to include opposite and matching jaws which have interlocking projections forming a cavity sized and shaped to compliment and accept wire rope cable so that the jaws may be quickly closed and locked around cable lengths to grip the cable lengths temporarily but firmly and in correct alignment until a conventional clamp can be installed.

4 Claims, 2 Drawing Sheets

LOCKING CABLE CLAMP

BACKGROUND OF THE INVENTION (A) Field of Invention

The present invention relates generally to gripping tools and more particularly relates to gripping tools for heavy wire rope cable.

(B) Description of Prior Art

The handling of heavy wire rope cable occurs in many industries such as telephone, electric, utilities, crane companies, construction, wire mills, the aircraft industry, naval yards, and shipbuilding, to name a few. For all of these industries the handling of heavy wire rope cable is done manually. Although handling of cable is an essential task, it is difficult and generally unpleasant. A great deal of strength must be used to maintain tension on the cable while the end of the cable is being anchored to a fixed structure. This operation requires at least two workers, one worker to hold and tension the cable and to loop the end of the cable around a fixed structure, the other worker to install the conventional cable clamp to the running length of the cable and the free end of the cable forming a loop around a fixed structure. The conventional cable clamp has a saddle portion which has a concave seat and a U-shaped bolt portion which are held together by nuts. The cable fits snugly within the concave part of the saddle portion of the clamp which is applied to the running length of the cable so as not to damage or crimp the running length of the cable when the clamp is tightened. Damage to the running length of the cable can greatly reduce the strength of the cable. The U-shaped bolt portion of the clamp engages the free end section of the cable. Heavy work gloves must be worn to avoid cuts and punctures by steel splinters from the cable which makes it difficult to handle the cable. One worker loops the end of the cable around a fixed structure and folds the free end of the cable against the running length of the cable while maintaining tension on the cable. The second worker installs the conventional cable clamp to the two lengths of cable and also helps to hold the two length of cable together. Frequently, the operation must be repeated which is time consuming and costly.

The use of locking pliers is extensively used in the prior art. However, although some of the prior art shows the use of a pair of locking pliers with specially designed jaws, none provide a versatile and portable locking pliers with specially designed jaws having interlocking and matching projections and having concavity which will clamp two cable lengths together.

Therefore, the primary objective of the invention is to provide a gripping tool for heavy wire rope cable which will enable a convention cable clamp to be installed to a cable without loss of tension. This operation can be accomplished by a single worker.

Another objective of the invention is to provide a tool of the locking pliers type in which the jaws are opposed to each other and having interlocking and matching projections forming a cavity which compliments and accepts two cable sections.

Another objective of the invention is to provide a tool of the locking pliers type having the above described characteristics which, once clamped and locked about a wire rope cable, will firmly hold that cable with substantial force.

Still another objective of the present invention is to provide a gripping tool of the locking pliers type having the above described characteristics which will hold the cable sections in correct alignment for easy acceptance of a conventional cable clamp.

A further objective of the present invention is to provide a gripping tool for heavy wire rope cable which is simple in construction, light weight, strong, durable, and which may be manufactured at a low cost and is easy to use.

These and other objectives of the present invention are more fully described in connection with the drawings an description that follow.

SUMMARY OF THE INVENTION

The tool of the present invention comprises a pair of locking pliers specifically designed to include opposite and matching jaws having interlocking projections and forming a cavity which firmly holds two cable section in alignment without loss of tension. Two cable sections are placed within the jaws and locked, thus leaving the hands of the worker free for installation of the conventional cable clamp so that the entire operation can be performed by a single worker.

BRIEF DESCRIPTION OF THE DRAWINGS

The character of the invention, however, may be best understood by reference to various specific structural forms, as illustrated by accompanying drawings in which.

DESCRIPTION OF THE PREFERRED EMBODIMENT

Figure 1:
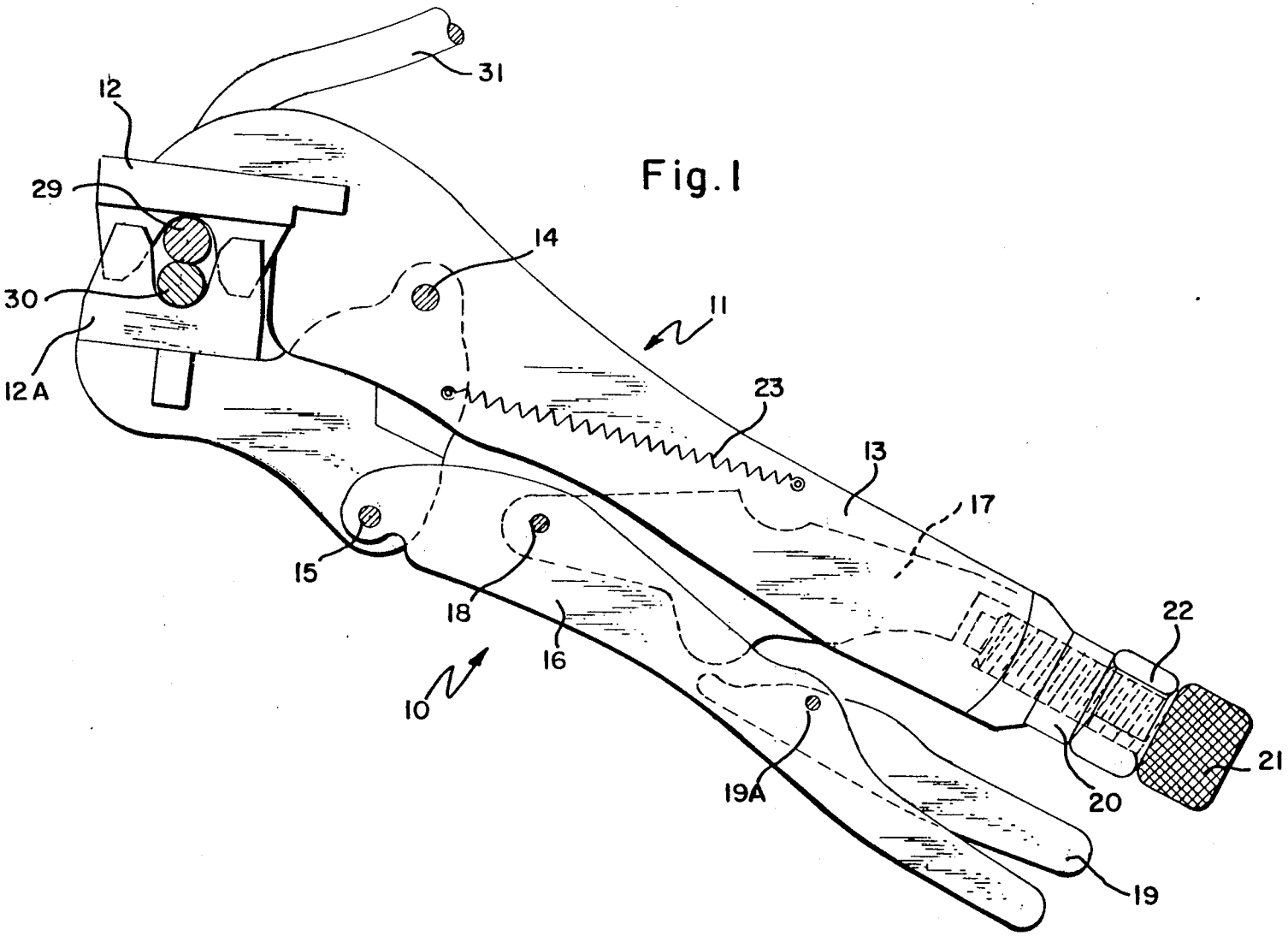
FIG. 1 is a perspective view of the locking cable clamp showing how a cable is arranged therein.
Figure 2:
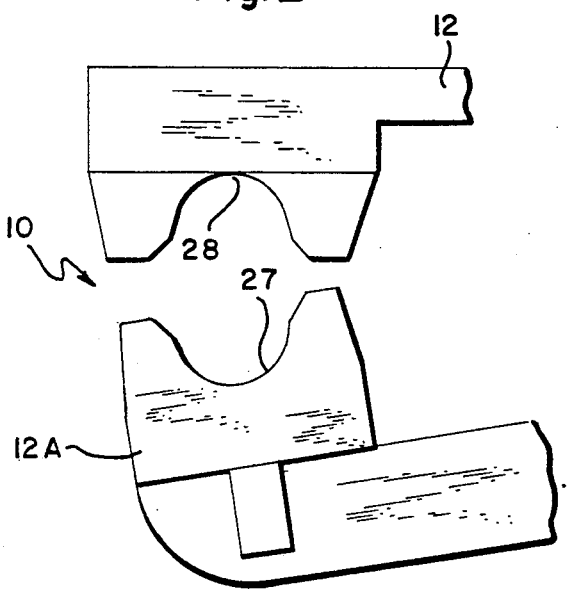
FIG. 2 is a fragmentary side elevation view of the gripping tool showing the upper and lower jaws in a partially open condition.
Figure 3:
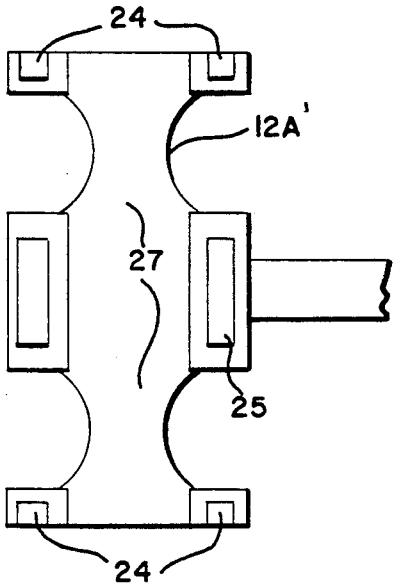
FIG. 3 is a top plan view of the bottom jaw.
Figure 4:
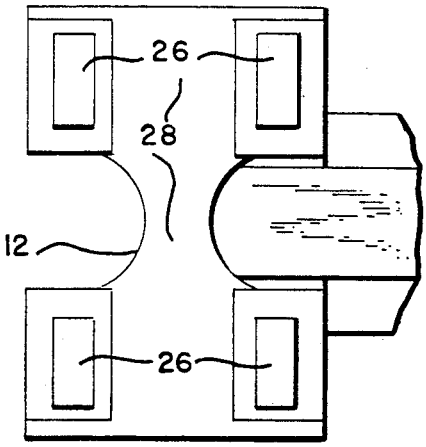
FIG. 4 is a bottom plan view of the top jaw and, FIG. 5 is a front elevational view of the gripping tool with the upper and lower jaws in a closed position.

Referring now to the drawings, and more particularly to FIG. 1, the tool of the invention is shown, generally identified by the numeral 10, as comprising locking pliers 11 with modified and improved jaws 12, 12A.

The locking pliers 11 are of the type described in U.S. Pat. Nos. 2,280,005 and 2,514,130. The pliers 11 generally comprise a first handle 13 of channel cross section having the modified jaw 12 preferably fixedly mounted at its forward end. The second modified jaw 12A is pivoted by hinge rivet 14 to the first handle and rear portion of jaw 12. A second handle 16, also of channel cross section, is pivoted to the rearwardmost lower portion of jaw 12A by the rivet 15. A connecting toggle link 17 is pivoted at its forward end by rivet 18 to jaw 12A and the second handle 16 rearwardly of pivot 15. The rear end of the toggle link 17 is slidably engaged in the first handle 13. A releasing lever 19 is disposed longitudinally in the second handle 16 and is pivotally connected to the toggle link 17 rearwardly of the second jaw 12A. The toggle link 17 is disposed at an oblique angle to the longitudinal axis of the handles 13, 16 and includes an angularly disposed portion which may continuously contact the inner surface of the second handle 16 when the second handle is in closed condition parallel to the first handle 13. The point at which the second jaw 12A approaches contact with and is locked against the first jaw 12 may be adjusted by turning the head 21 of a threaded rod 20 engaged in threads at the rear of the first handle 13, and whose inner end engages the rear end of the toggle link 17. The nut 22, on rod 20 inwardly of its head, serves to lock the toggle mechanism and maintain locking tension. Spring force to retain the locking pliers in their respective open and closed positions is provided by a coil spring 23 connected between the second jaw 12A at a point spaced from handle 16 and the handle 13. The release lever 19 is disposed on pivot a rearwardly of pivot 18 and so arranged that the forward end of the release lever is disposed under a rearward, raised portion of the toggle link 17. When the rear end of the release lever is depressed adjacent to the rear end of handle 16, the toggle link 17 is caused to be pivoted away from the handle 16 causing the spring 23 to open the jaws 12, 12A. From the above description of convention parts of the locking pliers, it will be understood that squeezing the handles 13, and 16 together moves the jaws 12 and 12A toward and into engagement with one another where they are retained in locked condition by the conventional toggle mechanism described, while unlocking and separation of the jaws 12 and 12A is achieved by simply lifting the release lever 19.

Referring now to FIGS. 2-5 wherein is illustrated the modified and improved jaws 12, 12A, it will be seen that both jaws are formed of strong tough metal mounted at 90° to handles 13 and 16 and pivot with respect to one another about rivet 14. The lower jaw 12A, FIG. 3, has a pair of upwardly-extending projections 25 intermediate the end projections 24. The upper jaw 12, FIG. 4, has a pair of spaced downwardly-extending projections 26 at each end of the jaw 12.

Figure 5:
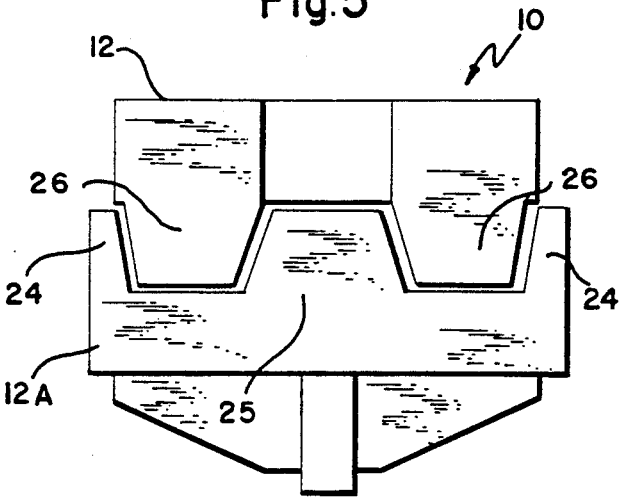

When the jaws 12, 12A are in the closed position as shown in FIG. 5 each projection 26 extends between a projection 24 and an intermediate projection 25, said jaws 12, 12A having matching and interlocking projections 24, 25, 26 which are opposed to each other. The lower jaw 12A has a concave surface or groove 27 which extends at a right angle to the handles 13, 16 of the tool 10 between the projections 24 and 25. The upper jaw 12 has a concave surface or groove 28 which extends at a right angle to the handles 13, 16 of the tool 10 between the projections 26. The concavities or grooves 27, 28 in each of said jaws 12, 12A, respectively, extend entirely across the jaws 12, 12A transversely thereof, the said concavities 27, 28 being aligned with each other and being so formed that in a closed condition the jaws 12, 12A together define a cylindrical recess, FIG. 2, capable of cooperatively gripping the peripheral surface of the cable lengths 29, 30 in a complimentary manner. The concavities 27, 28 of the upper jaw 12 and lower jaw 12A are roughened to provide frictional contact surfaces. The cable lengths 29, 30 to be clamped together are placed between the jaws 12, 12A so that one cable length 29 rests on the concave surface 28 and the other cable length 30 rests on the concave surface 27. When the upper and lower jaws 12, 12A, respectively, are brought together in a closed position and locked in place, the cable lengths 29, 30 are temporarily, but firmly clamped together without loss of tension and held in correct alignment for easy acceptance of the convention cable clamp. FIG. 1, a conventional cable clamp is then applied to the cable lengths 29, 30 and the gripping tool 10 is released and removed from the cable 31. The concave surfaces 27, 28 maintain maximum contact and gripping power on the cable lengths 29, 30 and minimize damage to the cable 31. The gripping tool 10 can also be used for various sizes of cable by turning the adjustment screw head 21 inward or outward. Turning the adjustment screw head 21 will also increase or decrease the gripping pressure upon the cable lengths 29, 30.

Although certain specific embodiments of the invention have been shown and described, it is obvious that many modifications thereof are possible. Therefore, it is to be understood that the invention is not limited thereto and that it can be variously practiced within the scope of the following claims.

I claim:

1. Locking pliers for releasable gripping two lengths of strand material one above the other, said locking pliers comprising:

(a) an elongated upper handle having a forward end and rearward end, (b) an upper jaw which is fixed to the forward end of the upper handle, said upper jaw having a downwardly facing clamping surface which has an upper groove which extends transversely of said upper handle, (c) a lower jaw which is pivotally connected to said upper handle for movement between a closed position and an open position relative to said upper jaw, said lower jaw having an upwardly facing clamping surface which has a lower groove which is parallel with and vertically aligned with said upper groove when said lower jaw is in said closed position and, (d) adjustable toggle means for locking said lower jaw in said closed position, and (e) at least one projection in one of said jaws which is forward of the groove in said one jaw, said projection extending from the clamping surface of said one jaw toward the clamping surface of the other of said jaws, the other of said jaws having a recess in the clamping surface of said other jaw which is forward of the groove in the other of said jaws and which is vertically aligned with said projection so that said projection extends into said recess when said lower jaw is in said closed position.

2. Locking pliers for releasable gripping two lengths of strand material one above the other, said locking pliers comprising:

(a) an elongated upper handle having a forward end and a rearward end, (b) an upper jaw which is fixed to the forward end of the upper handle, said upper jaw having a downwardly facing clamping surface which has an upper groove which extends transversely of said upper handle, (c) a lower jaw which is pivotally connected to said upper handle for movement between a closed position and an open position relative to said upper jaw, said lower jaw having an upwardly facing clamping surface which has a lower groove which is parallel with and vertically aligned with said upper groove when said lower jaw is in said closed position, (d) adjustable toggle means for locking said lower jaw in said closed position, (e) a projection which extends from the clamping surface of one of said jaws, said projection being forward of the the groove in said one jaw, and said projection extending toward the clamping surface of other of said jaws, and (f) at least two spaced projections which extend from the clamping surface of the other of said jaws and which are forward of the groove in said other jaw, said two spaced projections extending toward the clamping surface of said one jaw and being offset from said one projection on a line which is parallel with said grooves so that said one projection extends between said two projections when said lower jaw is in said closed position.

3. Locking pliers as recited in claim 2, wherein said jaws have projections as recited in claim 6 rearward of the grooves in said jaws.

4. Locking pliers as recited in claim 2, wherein each of said upper and lower jaws have a plurality of forward projections which are forward of said grooves and a plurality of rearward projections which are rearward of said grooves, the forward projections of said lower jaw interdigitating with the forward projections of said upper jaw and the rearward projections of said lower jaw interdigitating with the rearward projections of said upper jaw when said lower jaw in said closed position.

* * * * *